US011456128B1

(12) United States Patent
Chang et al.

(10) Patent No.: US 11,456,128 B1
(45) Date of Patent: Sep. 27, 2022

(54) KEY STRUCTURE

(71) Applicant: Primax Electronics Ltd., Taipei (TW)

(72) Inventors: Chia-Wei Chang, Taipei (TW); Tsung-Chin Tsai, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/361,955

(22) Filed: Jun. 29, 2021

(30) Foreign Application Priority Data

May 26, 2021 (TW) ..... 110119063

(51) Int. Cl.
*H01H 13/705* (2006.01)
*H01H 13/14* (2006.01)

(52) U.S. Cl.
CPC ..... *H01H 13/705* (2013.01); *H01H 13/14* (2013.01)

(58) Field of Classification Search
CPC ..... H01H 13/705; H01H 13/14; H01H 3/12; H01H 3/125; H01H 13/20; H01H 13/70; H01H 13/7065; H01H 13/7073; H01H 13/84; H01H 2215/03; H01H 13/85
See application file for complete search history.

(56) References Cited

U.S. PATENT DOCUMENTS 10,276,328 B1 * 4/2019 Cheng ..... H01H 13/7065
10,488,943 B2 * 11/2019 Jhuang ..... H01H 13/7073

* cited by examiner

*Primary Examiner* — Lheiren Mae A Caroc
(74) *Attorney, Agent, or Firm* — Kirton McConkie; Evan R. Witt

(57) ABSTRACT

A key structure includes a base plate, a supporting element, a resilience arm and a keycap. The keycap includes a bulge. The supporting element is installed on the base plate. The resilience arm is connected with the supporting element and aligned with the bulge of the keycap. The keycap is connected with the supporting element. When the keycap is moved toward the base plate, the bulge is moved downwardly to push the resilience arm. After the resilience arm is pushed by the bulge, the resilience arm is subjected to elastic deformation and separated from the bulge. After the resilience arm is separated from the bulge, the resilience arm knocks on the keycap, so that a sound is generated.

9 Claims, 4 Drawing Sheets

KEY STRUCTURE

FIELD OF THE INVENTION

The present invention relates to an input device, and more particularly to a key structure.

BACKGROUND OF THE INVENTION

Nowadays, membrane keyboards are widely used. In the membrane keyboard, an elastic element is used to trigger a membrane circuit board under a key structure, so that a key signal is generated. In contrast, when the metal components in a key structure of a mechanical keyboard are contacted with each other, the metal components are electrically conducted to generate a key signal. Consequently, when the key structure of the membrane keyboard is pressed down, the keycap is moved downwardly to knock on a base plate to generate a click sound. The click sound is quiet, deep and low. In other words, the click sound generated by the membrane keyboard is not similar to the bright rubbing sound of the metal component of the mechanical keyboard, and the pressing action on the key structure of the membrane keyboard does not generate the obvious vibration feel.

However, when the membrane keyboard is used, the user hopes that the pressing action on the key structure can generate bright sound and obvious vibration feel like the mechanical keyboard. As known, the mechanism of the membrane keyboard for generating the bright sound and the obvious vibration feel should be specially designed. In case that the mechanism for generating the click sound and the vibration is added to the membrane keyboard, the volume of the key structure of the membrane keyboard is largely increased. Consequently, the height and the weight of the key structure are increased, and the fabricating cost and the assembling complexity of the key structure are increased.

SUMMARY OF THE INVENTION

For solving the drawbacks of the conventional technologies, the present invention provides a key structure. The key structure is equipped with a sound generation mechanism. The arrangement of the sound generation mechanism does not largely increase the volume of the membrane keyboard. In response to the original pressing action, the sound generation mechanism of the key structure can generate the bright sound and the obvious vibration feel. Moreover, the sound generation mechanism of the key structure is the extensive structure of the original component of the key structure. Consequently, the fabricating cost is not largely increased, the assembling complexity is reduced, and the triggering function of the key structure is not adversely affected.

In accordance with an aspect of the present invention, a key structure is provided. The key structure includes a base plate, a circuit layer, an elastic element, a supporting element, a resilience arm and a keycap. The circuit layer is installed on the base plate. The elastic element is installed on the circuit layer. The supporting element is installed on the base plate. The elastic element is enclosed by the supporting element. The resilience arm is connected with the supporting element. The keycap covers the elastic element. The keycap is connected with the supporting element. The keycap includes a bulge corresponding to the resilience arm. When the keycap is moved toward the base plate, the bulge is moved downwardly to push the resilience arm. After the resilience arm is pushed by the bulge, the resilience arm is subjected to elastic deformation and separated from the bulge. After the resilience arm is separated from the bulge, the resilience arm knocks on the keycap, so that a sound is generated.

In an embodiment, the supporting element includes an outer frame and an inner frame. The outer frame is arranged around the inner frame. The resilience arm is connected with the outer frame.

In an embodiment, the supporting element includes a stopping block. The stopping block is installed on the outer frame of the supporting element and located under the resilience arm.

In an embodiment, the resilience arm includes a connecting part, a knocking part and a movable part. The connecting part is connected with the supporting element. The knocking part is aligned with the keycap. The movable part is aligned with the bulge of the keycap.

In an embodiment, the knocking part of the resilience arm is extended in a direction toward the keycap.

In an embodiment, the bulge of the keycap includes a pressing part. The pressing part is aligned with the movable part of the resilience arm. The movable part of the resilience arm is pressable by the pressing part.

In an embodiment, the keycap includes an inner wall and an inner surface. The bulge of the keycap is installed on the inner wall. The inner surface of the keycap is aligned with the knocking part of the resilience arm.

In an embodiment, when the keycap is moved toward the base plate, the keycap is moved downwardly to compress the elastic element, and the bulge of the keycap is moved downwardly to push the resilience arm. After the circuit layer is triggered by the elastic element, the resilience arm is the separated from the bulge, and the resilience arm knocks on the keycap.

In an embodiment, when an elastic restoring force of the resilience arm is higher than a pushing force of the bulge, the resilience arm is separated from the pressing part, and the resilience arm knocks on the keycap.

From the above descriptions, the present invention provides the key structure. The resilience arm is extensively installed on the supporting element. The bulge is protruded from the keycap. After the bulge is moved downwardly to push the resilience arm, the resilience arm is restored back to knock on the keycap to generate sound and vibration. Consequently, the key structure can generate the click sound and provide the tactile feel without the need of changing the original components of the key structure.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1A:
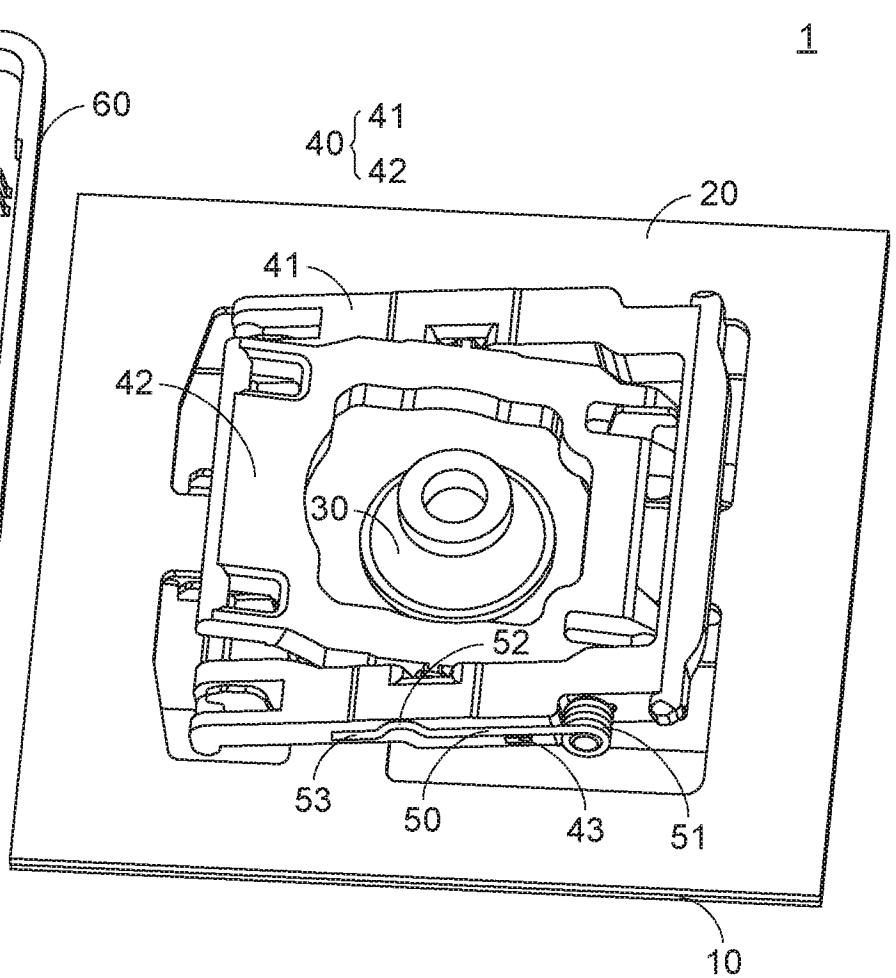
FIGS. 1A and 1B form a schematic exploded view illustrating a key structure according to an embodiment of the present invention.
Figure 1B:
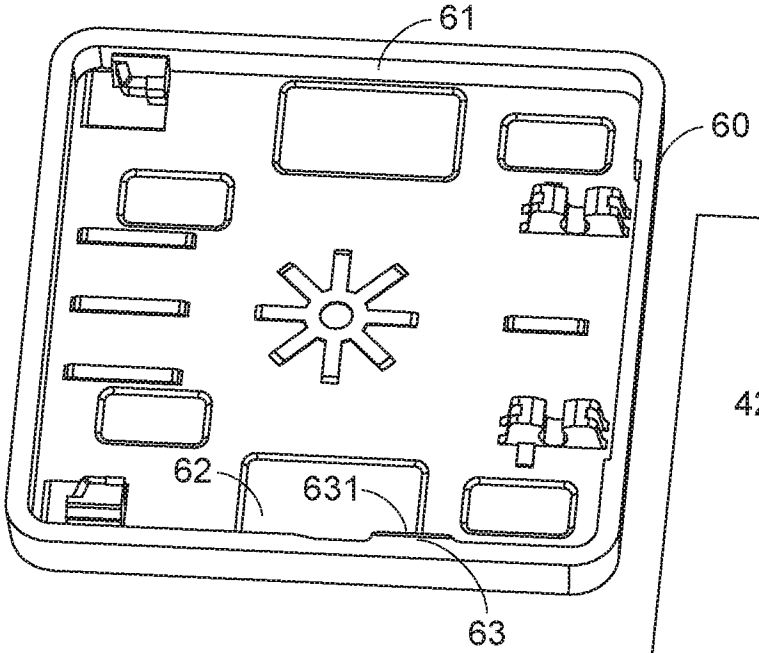
Figure 2:
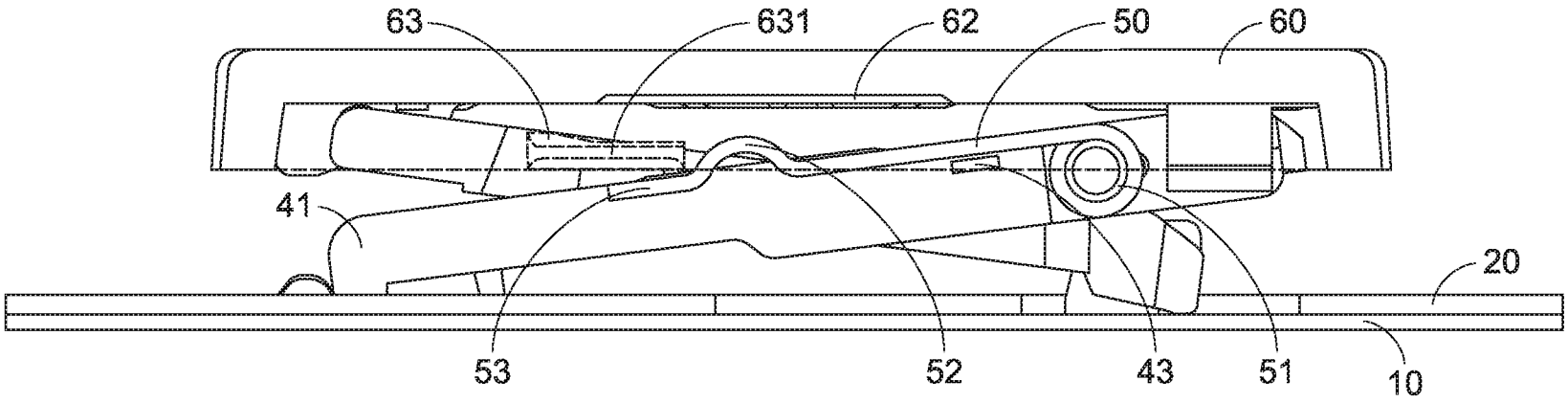
FIG. 2 is a schematic side view illustrating the key structure as shown in FIGS. 1A and 1B.

Please refer to FIGS. 1A, 1B, and 2. FIGS. 1A and 1B form a schematic exploded view illustrating a key structure according to an embodiment of the present invention. FIG. 2 is a schematic side view illustrating the key structure as shown in FIGS. 1A and 1B. As shown in FIGS. 1A, 1B, and 2, the key structure 1 comprises a base plate 10, a circuit layer 20, an elastic element 30, a supporting element 40, a resilience arm 50 and a keycap 60.

The keycap 60 comprises a bulge 63. The circuit layer 20 is installed on the surface of the base plate 10. The elastic element 30 is installed on the circuit layer 20. The supporting element 40 is installed on the base plate 10, and the elastic element 30 is enclosed by the supporting element 40. The resilience arm 50 is connected with the supporting element 40. The keycap 60 covers the elastic element 30. In addition, the keycap 60 is connected with the supporting element 40. The position of the bulge 63 of the keycap 60 is aligned with the position of the resilience arm 50. When the keycap 60 is pressed down, the keycap 60 is moved toward the base plate 10, and the bulge 63 is moved downwardly to push the resilience arm 50. As the resilience arm 50 is pushed by the bulge 63, the resilience arm 50 is subjected to elastic deformation. After the resilience arm 50 is subjected to deformation, the resilience arm 50 is no longer pushed by the bulge 63. Moreover, due to the elasticity of the resilience arm 50, the resilience arm 50 knocks on the keycap 60 to generate sound and vibration.

In an embodiment, the supporting element 40 comprises an outer frame 41, an inner frame 42 and a stopping block 43. The resilience arm 50 comprises a connecting part 51, a knocking part 52 and a movable part 53. The keycap 60 comprises an inner wall 61 and an inner surface 62. The bulge 63 of the keycap 60 comprises a pressing part 631. The outer frame 41 of the supporting element 40 is arranged around the inner frame 42. The resilience arm 50 is connected with the outer frame 41. The stopping block 43 is installed on the outer frame 41 and located under the resilience arm 50. The stopping block 43 is used for stabilizing the position of the resilience arm 50. When the resilience arm 50 is pressed, the stopping block 43 can be used as a fulcrum to support the resilience arm 50. Consequently, the resilience arm 50 can be restored. The connecting part 51 of the resilience arm 50 is fixed on the outer frame 41 of the supporting element 40. The knocking part 52 and the movable part 53 are not fixed. After the knocking part 52 and the movable part 53 are pressed, the knocking part 52 and the movable part 53 can be elastically swung. The knocking part 52 of the resilience arm 50 is aligned with the inner surface 62 of the keycap 60. The knocking part 52 is extended in the direction toward the inner surface 62 of the keycap 60. The movable part 53 of the resilience arm 50 is aligned with the bulge 63 of the keycap 60. The bulge 63 of the keycap 60 is installed on the inner wall 61 of the keycap 60. In addition, the pressing part 631 of the bulge 63 is aligned with the movable part 53 of the resilience arm 50. When the movable part 53 of the resilience arm 50 is pressed by the pressing part 631 of the bulge 63, the resilience arm 50 is subjected to elastic deformation.

Figure 3:
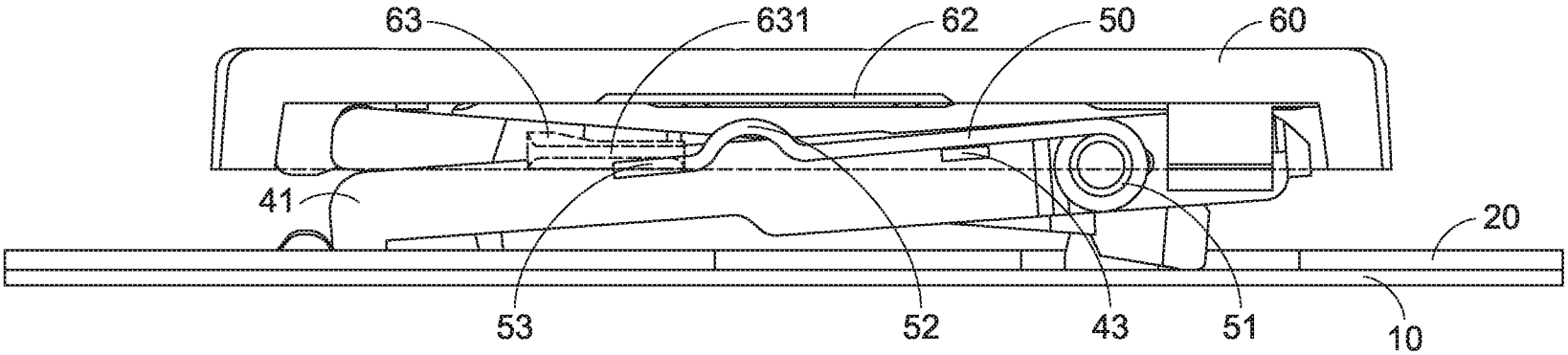
FIG. 3 is a schematic cross-sectional view illustrating the usage state of the key structure when the keycap is pressed down.
Figure 4:
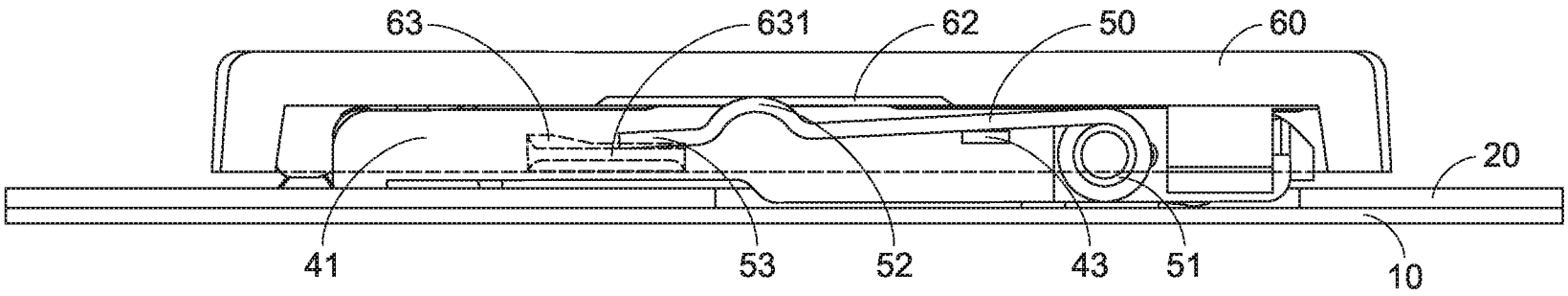
FIG. 4 is a schematic cross-sectional view illustrating the usage state of the key structure when the keycap is continuously pressed down.

The usage status of the key structure 1 will be described as follows. FIG. 3 is a schematic cross-sectional view illustrating the usage state of the key structure when the keycap is pressed down. FIG. 4 is a schematic cross-sectional view illustrating the usage state of the key structure when the keycap is continuously pressed down.

Please refer to FIG. 3. When the keycap 60 is pressed down, the keycap 60 is moved downwardly toward the base plate 10 to compress the elastic element 30 (not shown). As the keycap 60 is moved downwardly, the bulge 63 of the keycap 60 is correspondingly moved toward the base plate 10, and the pressing part 631 of the bulge 63 is moved downwardly to push the movable part 53 of the resilience arm 50. In response to the downward pressing force, the resilience arm 50 is subjected to elastic deformation. Under this circumstance, the stopping block 43 of the supporting element 40 exerts an upward force on the resilience arm 50.

Please refer to FIG. 4. When the keycap 60 is continuously pressed down to compress the elastic element 30 (not shown), the circuit layer 20 is triggered by the elastic element 30, so that a key signal (not shown) is generated. In response to the elastic deformation of the resilience arm 50, the resilience arm 50 is separated from the pressing part 631 of the bulge 63. Alternatively, if the elastic restoring force of the resilience arm 50 is higher than the pushing force of the pressing part 631 of the bulge 63, the resilience arm 50 is separated from the pressing part 631 of the bulge 63. After the resilience arm 50 is separated from the pressing part 631 of the bulge 63, the knocking part 52 and the movable part 53 of the resilience arm 50 are swung toward the keycap 60 in response to the elastic inertia, and the bulge 63 is moved to the position over the bulge 63. Consequently, the knocking part 52 of the resilience arm 50 knocks on the inner surface 62 of the keycap 60, and a bright click sound and a vibration feel are generated.

When the keycap 60 is no longer pressed, the elastic element 30 is restored to push the movement of the keycap 60 in the direction away from the base plate 10. As the keycap 60 is moved away from the base plate 10, the bulge 63 is correspondingly moved away from the base plate 10. At the same time, the pressing part 631 of the bulge 63 is slid across the movable part 53 of the resilience arm 50. Consequently, the movable part 53 of the resilience arm 50 is slid downwardly along the surface of the pressing part 631 and returned to the position under the pressing part 631. Then, the next pressing action can be performed accordingly.

In an embodiment, the resilience arm 50 is a metal spring strip or a plastic strip with an elastic property. Preferably, the stopping block 43 of the supporting element 40 is installed at the nearby position of the connecting part 51 of the resilience arm 50. Optionally, a metal plate is installed on the inner surface 62 of the keycap 60 and aligned with the knocking part 52 of the resilience arm 50. Consequently, the click sound is more obvious.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate;

a circuit layer installed on the base plate;

an elastic element installed on the circuit layer;

a supporting element installed on the base plate, wherein the elastic element is enclosed by the supporting element;

a resilience arm connected with the supporting element; and a keycap covering the elastic element, wherein the keycap is connected with the supporting element, and the keycap comprises a bulge corresponding to the resilience arm, wherein when the keycap is moved toward the base plate, the bulge is moved downwardly to push the resilience arm, wherein after the resilience arm is pushed by the bulge, the resilience arm is subjected to elastic deformation and separated from the bulge, wherein after the resilience arm is separated from the bulge, the resilience arm knocks on the keycap, so that a sound is generated.

2. The key structure according to claim 1, wherein the supporting element comprises an outer frame and an inner frame, wherein the outer frame is arranged around the inner frame, and the resilience arm is connected with the outer frame.

3. The key structure according to claim 2, wherein the supporting element comprises a stopping block, wherein the stopping block is installed on the outer frame of the supporting element and located under the resilience arm.

4. The key structure according to claim 1, wherein the resilience arm comprises a connecting part, a knocking part and a movable part, wherein the connecting part is connected with the supporting element, the knocking part is aligned with the keycap, and the movable part is aligned with the bulge of the keycap.

5. The key structure according to claim 4, wherein the knocking part of the resilience arm is extended in a direction toward the keycap.

6. The key structure according to claim 4, wherein the bulge of the keycap comprises a pressing part, wherein the pressing part is aligned with the movable part of the resilience arm, and the movable part of the resilience arm is pressable by the pressing part.

7. The key structure according to claim 4, wherein the keycap comprises an inner wall and an inner surface, wherein the bulge of the keycap is installed on the inner wall, and the inner surface of the keycap is aligned with the knocking part of the resilience arm.

8. The key structure according to claim 1, wherein when the keycap is moved toward the base plate, the keycap is moved downwardly to compress the elastic element, and the bulge of the keycap is moved downwardly to push the resilience arm, wherein after the circuit layer is triggered by the elastic element, the resilience arm is separated from the bulge, and the resilience arm knocks on the keycap.

9. The key structure according to claim 1, wherein when an elastic restoring force of the resilience arm is higher than a pushing force of the bulge, the resilience arm is separated from the pressing part, and the resilience arm knocks on the keycap.

* * * * *